US005620379A

United States Patent [19]

Borys

[11] Patent Number: 5,620,379

[45] Date of Patent: Apr. 15, 1997

[54] PRISM GOLF CLUB

[76] Inventor: Robert A. Borys, 19 Cuthbertson Place, Winnipeg, Canada, R3P 0S7

[21] Appl. No.: 354,845

[22] Filed: Dec. 9, 1994

[51] Int. Cl.[6] ..... A63B 53/04

[52] U.S. Cl. ..... 473/313; 473/325; 473/340; 473/314

[58] Field of Search ..... 273/167 R, 77 R, 273/167 D, 167 A, 164.1, 163 R, 167 G, 80 C, 193 R, 167 F, 169, 168, 167 J, 167 K; D21/217, 218, 219; 473/324–350, 304–314, 251, 282

[56] References Cited

U.S. PATENT DOCUMENTS

| | | | |
|---|---|---|---|
| D. 58,209 | 6/1921 | Bacheller | 273/164.1 |
| D. 234,962 | 4/1975 | Swash | 273/78 |
| D. 325,414 | 4/1992 | Woolsey | D21/219 |
| 1,703,199 | 2/1929 | McClure | 273/80 C |
| 2,820,638 | 1/1958 | Morrison | 273/80 C |
| 2,954,231 | 9/1960 | Macintyre | 273/164.1 |
| 2,957,696 | 10/1960 | Warpotas | 273/164.1 |
| 3,019,022 | 1/1962 | Ehmke | 273/163 R |
| 3,143,349 | 8/1964 | Macintyre | 273/164.1 |
| 3,448,981 | 6/1969 | Anweiler | 273/164.1 |
| 3,459,426 | 8/1969 | Sherwood | 273/164.1 |
| 3,486,755 | 12/1969 | Hodge | 273/168 X |
| 4,141,556 | 2/1979 | Paulin | 273/164.1 |
| 4,592,552 | 6/1986 | Garber | 273/167 H |
| 4,712,798 | 12/1987 | Preato | 273/167 A |
| 5,082,277 | 1/1992 | Gingold | 273/164.1 |

FOREIGN PATENT DOCUMENTS

| | | | |
|---|---|---|---|
| 10497 | 5/1907 | United Kingdom | 273/168 |
| 2149670 | 6/1985 | United Kingdom | 273/164.1 |

*Primary Examiner*—Sebastiano Passaniti
*Attorney, Agent, or Firm*—Murray E. Thrift; Adrian D. Battison

[57] ABSTRACT

A golf club has a triangular prismatic head. The top and bottom faces of the club head are parallel and of isosceles triangular shape. The shaft is aligned with the center of mass of the club head. The improved balance and visual cues given by the triangular prismatic shape improve the club positioning and stroke.

1 Claim, 2 Drawing Sheets

PRISM GOLF CLUB

FIELD OF THE INVENTION

The present invention relates to golf clubs and more particularly to a golf club head having a novel head configuration and to a club incorporating the head.

BACKGROUND

Various golf clubs have been designed in the past, usually in an effort to improve the performance of the club in striking a ball. The present invention is concerned with a club configuration that assists the golfer in aligning the club to the golfer's body and both the club and the body to a target.

SUMMARY

According to one aspect of the present invention there is provided a golf club head having a flat striking face and parallel top and bottom surfaces, the top surface having a substantially isosceles triangular shape, the base of the triangular shape being along the striking face.

Preferably, the club head is a triangular prism. It is also preferred that in the complete club, the shaft extends along a line through the center of mass of the club head.

The head design allows a golfer to simplify shot aiming, to steady the club on impact, to smooth the motion of the stroke and to increase the "feel" of the stroke.

The triangular shape of the head provides improved visual indications to a golfer of the alignment of the club both to the ball and to the golfer's body and feet. Misalignments and inconsistencies in stance and stroke are more readily apparent than with a conventional club that does not display the distinctive geometric visual cues as to its orientation.

The flat top surface, parallel to the bottom, provides a stable, visible, horizontal plane when the club is on the ground. Misalignments of the club with the ground are readily detected and corrected. With the shaft axis passing through the center of mass, the torque exerted on the shaft by an off-center impact is minimized. This improves both the feel and control of the stroke.

With the improved visual cueing from the club head, stroke consistency is considerably improved.

Another aspect of the invention provides a golf club including the novel head.

BRIEF DESCRIPTION OF THE DRAWINGS

In the accompanying drawings, which illustrate an exemplary embodiment of the present invention.

DETAILED DESCRIPTION

Figure 1:
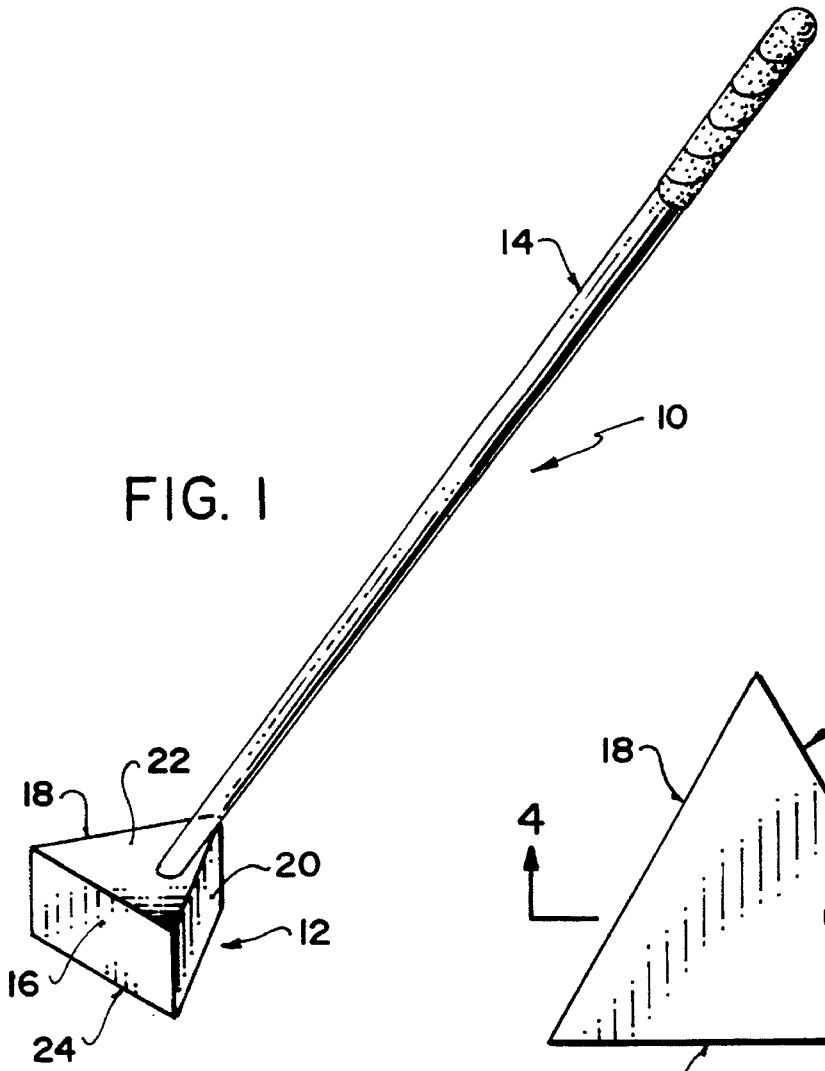
FIG. 1 is an isometric view of a club according to the present invention.

Referring to the accompanying drawings, there is illustrated a golf club 10 with a head 12 and a shaft 14. The head is of triangular prismatic form with a flat striking face 16 on the front of the head and two back faces 18 and 20 sloping from opposite ends of the front face to an apex at the back of the club. The top and bottom faces of the club head are of an isosceles triangular shape, with the base extending along the striking face. The top face 22 and bottom face 24 of the club head are substantially flat and parallel.

Figure 3:
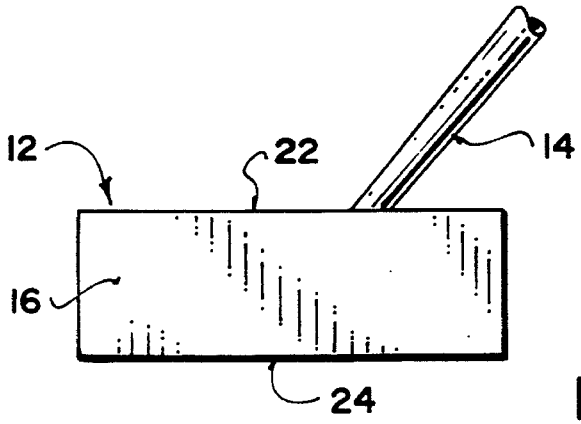
FIG. 3 is a partial front view showing the head.
Figure 4:
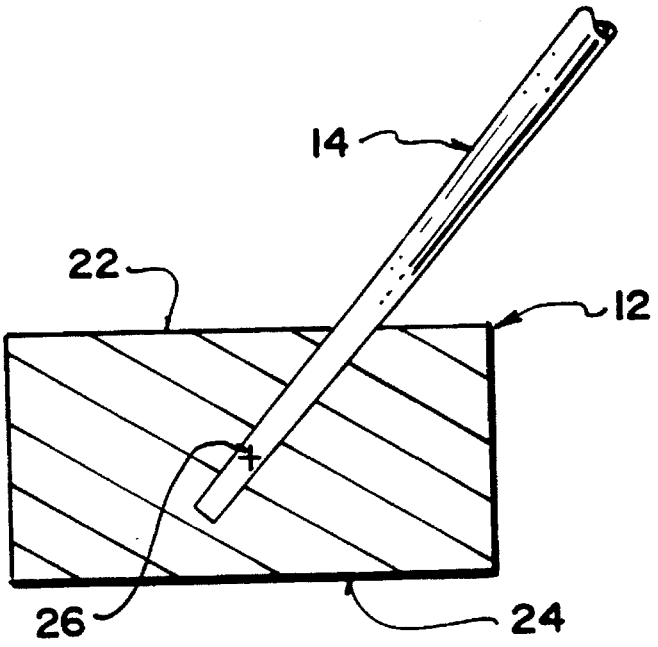
FIG. 4 is a cross-section along line 4—4 of FIG. 2.

As shown in FIGS. 3 and 4, the top and bottom faces 22 and 24 are perpendicular to the back sides 18 and 20.

Figure 2:
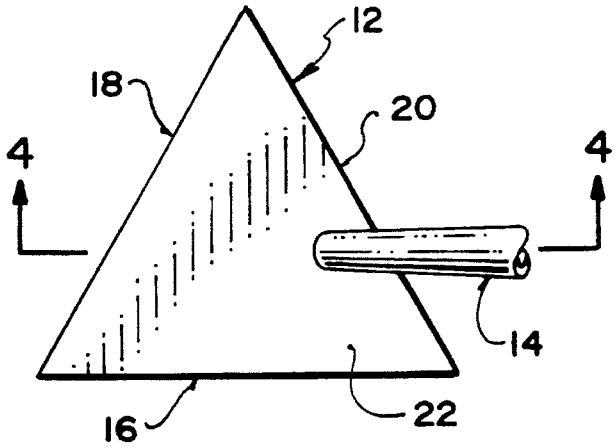
FIG. 2 is a partial plan view of the club.

As shown most clearly in FIG. 4, the club head has a center of mass 26. The shaft 14 of the club extends along a line that passes through this center of mass. It lies in a plane parallel to the striking face 16 of the club head. As shown in FIG. 2, the shaft is positioned closer to the striking face than the apex between the back faces. The shaft intersects the top surface at a position closer to the heel of the club head than to the toe.

Figure 5:
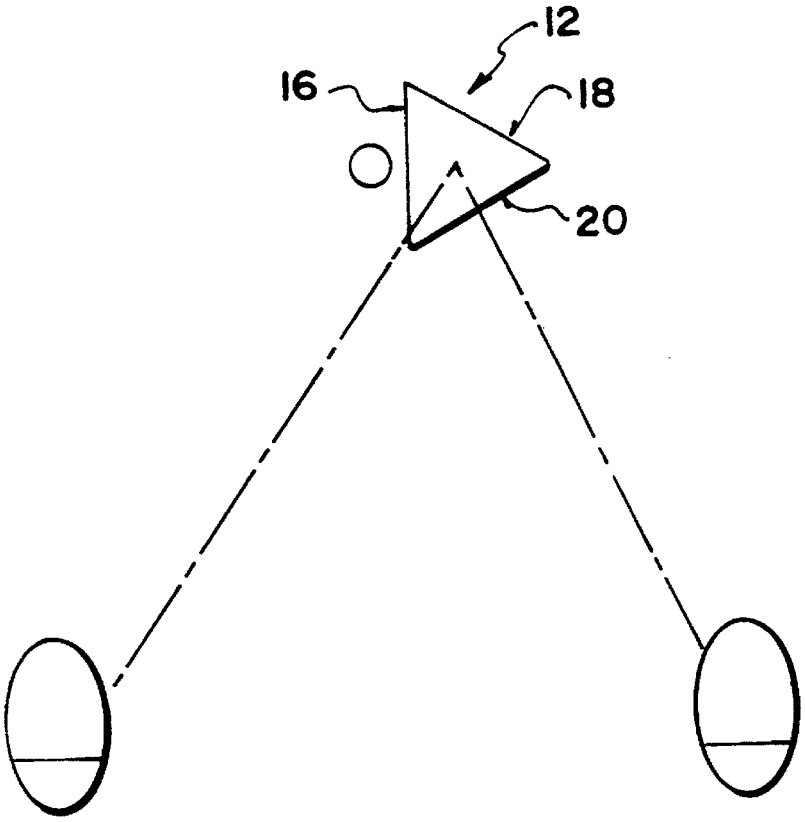
FIG. 5 is an illustration showing the relationship of the club to a golfer's stance.

In use of the club, as illustrated in FIG. 5, the faces of the club, and especially the back faces, give distinct visual cues as to the proper positioning of the club with respect to the golfer's feet and with respect to the ball. It is immediately apparent if the club is skewed because the visual symmetry of the club positioning is quite striking. At the same time, the relatively large flat top surface of the club gives a clear indication to the golfer whether the club head is properly aligned with respect to the ground. All of this becomes apparent when the golfer addresses the ball and any errors or inconsistencies in the stance can be corrected, leading to a far more consistent stroke and improved play.

While one embodiment of the present invention has been described and illustrated above, it is to be understood that various embodiments of the invention are possible. The invention is applicable to clubs of all types, including putters, irons and woods. The invention is therefore to be considered limited solely by the scope of the appended claims.

I claim:

1. A gold club comprising a club head and a shaft, the club head consisting of a triangular prismatic shape composed of a single flat striking face, two back faces meeting at an apex and flat, parallel top and bottom surfaces of isosceles triangular shape, the top and bottom surfaces being perpendicular to the back faces and the base of the triangle being along the striking face, and the club head having a center of mass and the shaft comprising a substantially straight shaft substantially aligned along a shaft axis lying in a plane parallel to the striking face and extending through the center of mass of the club head, the shaft thereby intersecting the top surface of the head at a position closer to the heel of the club head than the toe, said shaft axis plane being positioned closer to the striking face than to the apex between the back faces.

* * * * *